United States Patent [19]

Klänne

[11] Patent Number: 5,007,500

[45] Date of Patent: Apr. 16, 1991

[54] DEVICE FOR THE MAINTENANCE OF LARGE-CAPACITY CONTAINERS

[75] Inventor: Harald Klänne, Berlin, Fed. Rep. of Germany

[73] Assignee: ISB Generalunternehmen fur Industriespezialbau, Berlin, Fed. Rep. of Germany

[21] Appl. No.: 293,632

[22] Filed: Jan. 5, 1989

[30] Foreign Application Priority Data

Jan. 6, 1988 [DE] Fed. Rep. of Germany ..... 3800344
Sep. 8, 1988 [DE] Fed. Rep. of Germany ..... 3830589

[51] Int. Cl.[5] ..... E04G 3/10; E04G 3/14

[52] U.S. Cl. ..... 182/38; 182/128; 182/150; 182/187

[58] Field of Search ..... 182/142, 143, 144, 150, 182/128, 36, 37, 38, 187

[56] References Cited

U.S. PATENT DOCUMENTS

| | | | |
|---|---|---|---|
| 1,101,839 | 6/1914 | Elvestrom | 182/142 |
| 3,114,433 | 12/1963 | Downs | 182/142 |
| 3,537,545 | 11/1970 | Willis | 182/142 |
| 3,854,550 | 12/1974 | Shingler | 182/142 |
| 4,234,055 | 11/1980 | Beeche | 182/142 |

FOREIGN PATENT DOCUMENTS

| | | | |
|---|---|---|---|
| 269773 | 9/1988 | U.S.S.R. | 182/128 |

*Primary Examiner*—Reinaldo P. Machado
*Attorney, Agent, or Firm*—William D. Blackman; Arnold S. Weintraub

[57] ABSTRACT

A device for the maintenance of large-capacity containers such as storage tanks or the like vessels is described, which consists of a scaffolding structure for accommodating a plurality of working platforms along the container wall, such scaffolding structure reposing swingably around the vertical centerline which is the rotation axis. For this purpose, the device is movable along the total peripheral area of the upper container wall. In three preferred embodiments, the device may consist either of a centrally supported pivot mounting supported on the container roof, which is horizontally adjustable and vertically settable around an air dome, or of a load-carrying support which is placed centrally on the container roof, or finally of a load-carrying support reposing movably on a uppermost container edge and a tank catwalk, such load-carrying support being composed in turn of a lattice carrier and a frame.

12 Claims, 13 Drawing Sheets

DEVICE FOR THE MAINTENANCE OF LARGE-CAPACITY CONTAINERS

BACKGROUND OF THE INVENTION

1. Field of the Invention

The present invention relates to devices for the maintenance of large-capacity containers, such as storage tanks or the like vessels, having preferably an at least approximately round cross section.

2. Prior Art

Large-capacity containers of the here pertinent variety are tanks used for the storage of gases or liquids of any nature, such as city gas, petroleum, various petroleum fractions and other fluids, but also of solids such as fine dusts or the like. Such storage tanks are usually structures which are symmetrical with respect to rotation seen from a central, vertical axis, and are generally of cylindrical, or spherical form. Since their height often corresponds to that of a building of several stories and they are frequently accessible only with difficulties on account of their specific locations, their maintenance results to be difficult, time-consuming and therefore expensive in a large number of practical cases.

The maintenance of storage tanks is, however, of prime importance, particularly if they contain easily inflammable, chemically aggressive or even explosive substances, such maintenance being therefore logically required in relatively short intervals by law, even though such laws and regulations may differ in wording, according to the countries concerned.

The scaffolding of such large-capacity containers using commercial structures, such as scaffolding tubes with clamp straps, and the provision of a plurality of working platforms which are superposed one above the other with the scaffolding structure and are accessible by means of ladders, is known.

The existing tank containers having a circular cross section are usually scaffolded by segments, i.e., by only certain partial areas of their peripheral area, so as to successively carry out the required maintenance work on such large-capacity containers; such as renewing or repair work of any nature gradually by continued re-scaffolding parts of such containers. The parts of the scaffold must therefore not be tied to the container walls in a form that the walls would be damaged due to drilling or the application of fitting plates or be exposed to other additional loads. The above mentioned scaffold structures therefore require additional stabilizing jacks and/or supporting struts placed outside of the scaffold structure, hampered often by difficult subsoil conditions such as loose sands or ditches around such large-capacity containers.

Aside from such total scaffoldings or segment-wise scaffolding with its successive time-consuming scaffold constructions, also a variety of suspended platforms have been known, such platforms using a method in which a working platform is practically suspended on two ropes which are fastened to the upper edge of such container at a certain spot and are movable along its total height by way of a lift. This is done by means of a crank handle provided on the working platform or also by an electric motor which raises the working platform or optionally lowers it. Repair work is possible in such cases only along the small segment section of the large-capacity container as determined by the length of the suspended working platform. Also in such cases, both the remounting of the suspended platform and new securing from section to section are required.

In addition to the difficulties of the known scaffold structures for the maintenance of large-capacity containers, it must be taken into consideration that such storage tanks may be provided with solid roof structures or with floating roofs, in accordance with their purpose, and also with covers of different shapes, e.g., also with such containers having central air shafts or so-called dome superstructures, or that they may be flat-floor tanks with double walls.

SUMMARY OF THE INVENTION

This is where the present invention comes in, the object of which is to provide a means of carrying out the maintenance work of such large-capacity containers—irrespective of their design—such as repair and/of renovation work substantially easier and quicker than is possible with the prior art devices, with at the same time minimized material expenses for the scaffolding structure which is made of only a possibly small number of standardized component parts.

Due to the fact that the known usual total or partial scaffolding of such large-capacity containers braced upon the ground and in addition also lift-wise suspended working platforms are herein completely desisted from, the aforementioned known disadvantages in this respect do not apply. The device for the maintenance of large-capacity containers according to the present invention being a running device for storage containers of all kinds, it is particularly simple in its design, and can be assembled and disassembled easily and without the use of special tooling; it can be infinited variably swiveled, suspended from the tank, and moved around its total circumference without problems, irrespective of the location of such large-capacity container and its surrounding soil condition, and neither the container wall nor the container cover must meet special requirements.

In the present invention, working platforms can be laid into suspended ladder frames hanging from the top downwards, in any wanted height of the scaffolding structure and at the desired distances, the working platforms representing in themselves standardized component parts. The scaffolding structure consists in its essential parts of known, commercially available material as is used for the scaffolding of buildings and the like, i.e., component parts of tubular frames.

In the case of storage tanks with a central air shaft or discharge dome for vents there will be added one or a plurality of crane-jib-like connecting pieces which are likewise of material-saving design, and in the case of large-capacity vessels with solid roofs without a central air shaft, a rotary axle mounting structure is used, the versatile operational possibilities of which are characterized by a simple but effective construction using a few standardized component parts.

The attached figures show, partly in the form of diagrammatic representations, various embodiments of the inventive device for the maintenance of large-capacity containers of all kinds with preferably rotational-symmetrical cross section.

The following examples show further advantages and individual characteristics which are further explained and described taking reference to the various figures, in which:

DETAILED DESCRIPTION OF THE PREFERRED EMBODIMENT

Figure 1:
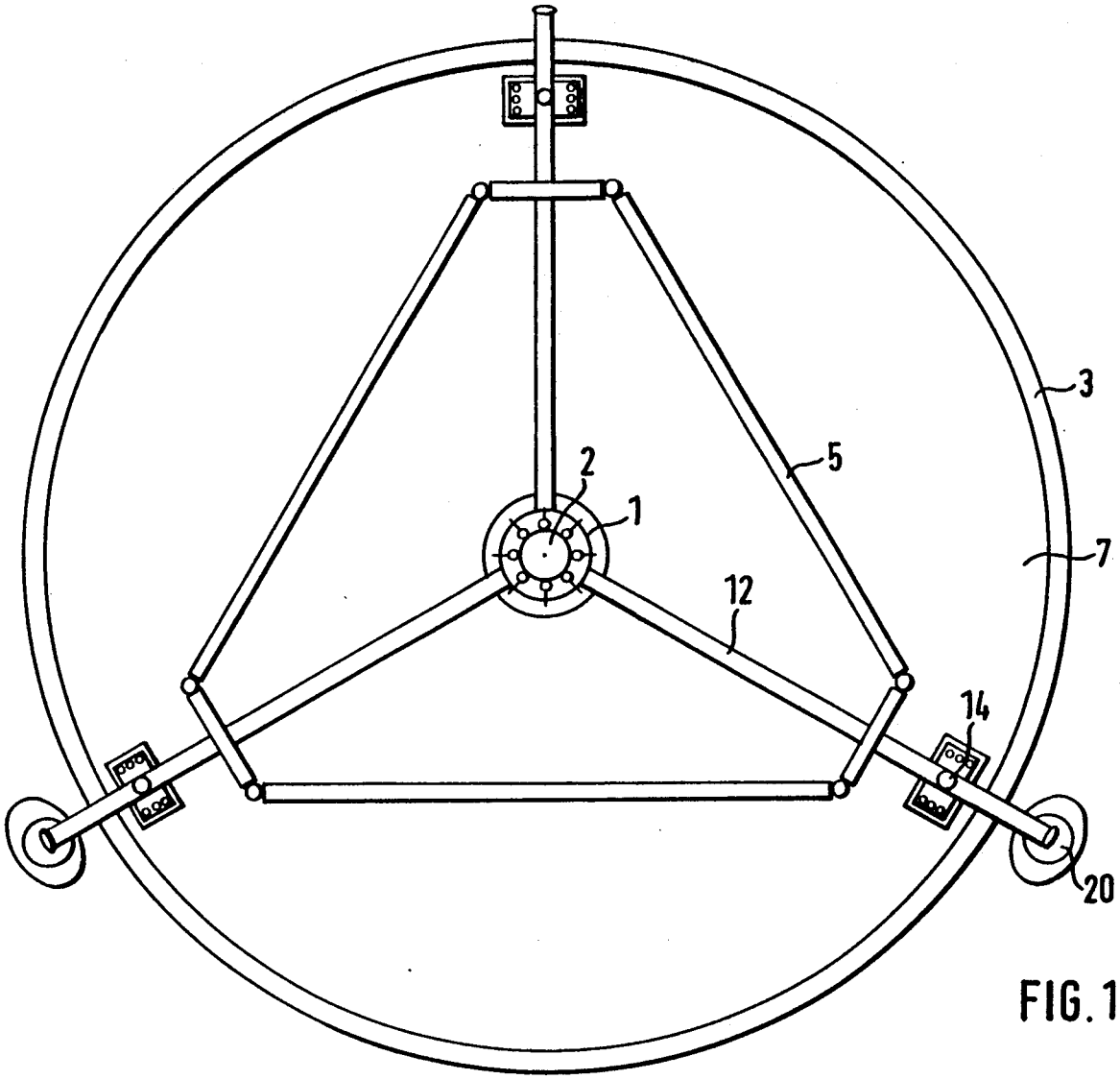
FIG. 1 is a top view of a cylindrical large-capacity container with a centrally fixed pivot mounting for accommodating the scaffolding structure, of the present invention.

In accordance with the FIGS. 1 through 6, a first embodiment of the device for the maintenance of the partly represented cylindrical storage tank 3 includes a pivot mounting 1 disposed centrally around a dome shaft 2, to which—in the first embodiment—swivel arms 12 are held radially extending outward in angles of 120° with respect to one another, the swivel arms 12 being fixed to one another by means of braced links 5. The first embodiment also includes load-carrying supports 14 located at the radially outer ends of said swivel arms 12 in the area of the upper edge of the container 3. Scaffolding structures for accommodating platforms are attached, hanging downward, to extensions of the swivel arms 12 protruding radially outward over the container edge 7.

The pivot mounting 1 forms a closed flange bushing around the air or dome shaft 2 provided centrally on the large-capacity container 3.

Figure 2:
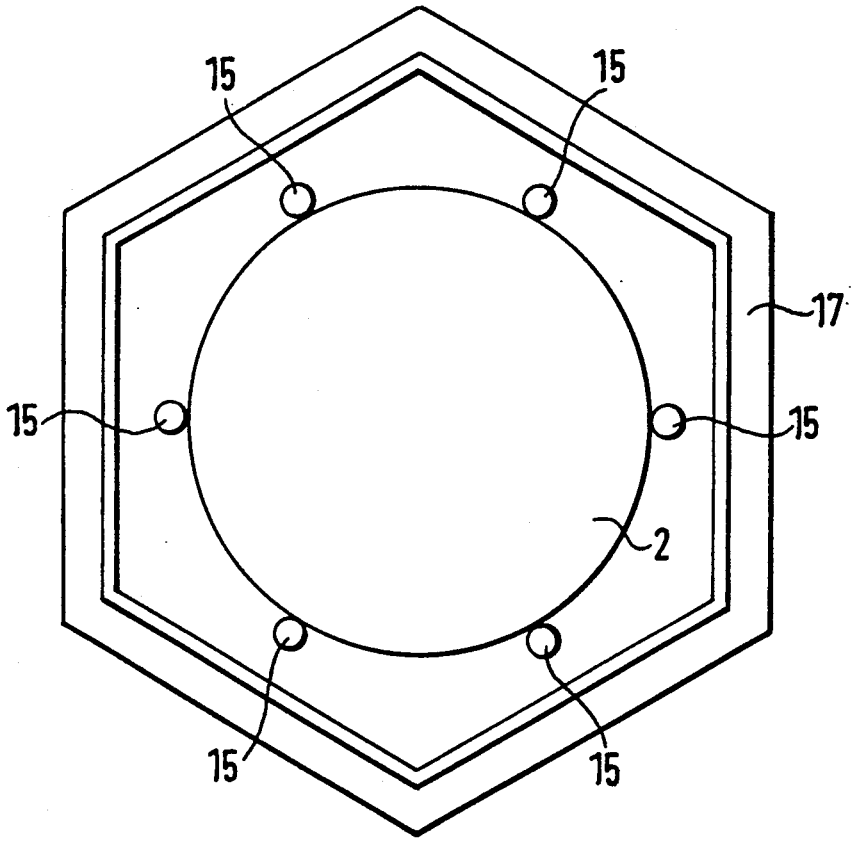
FIG. 2 is a top view of a pivot mounting fixed around a dome shaft.
Figure 3:
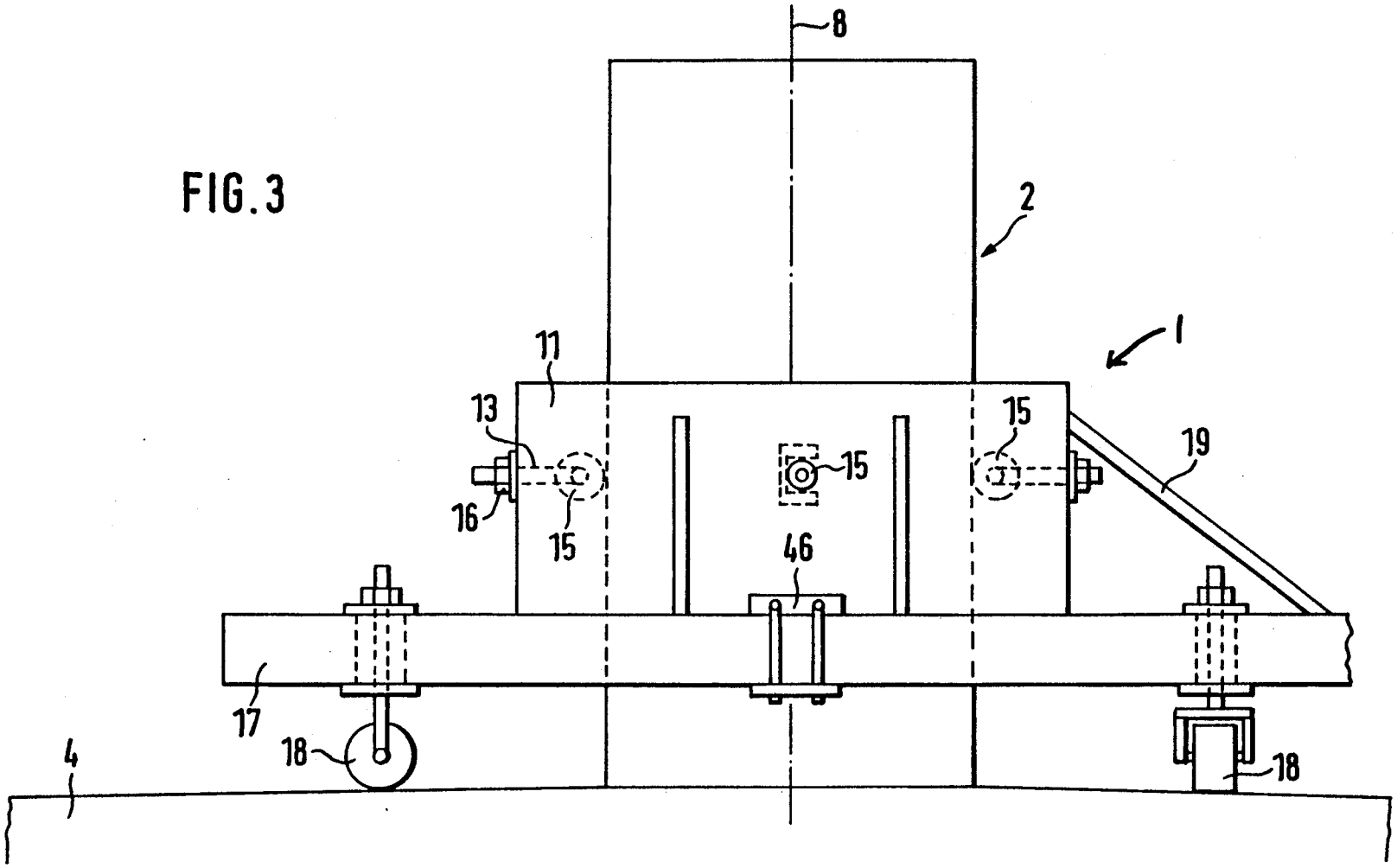
FIG. 3 is a side view of the device according to FIG. 2.
Figure 4:
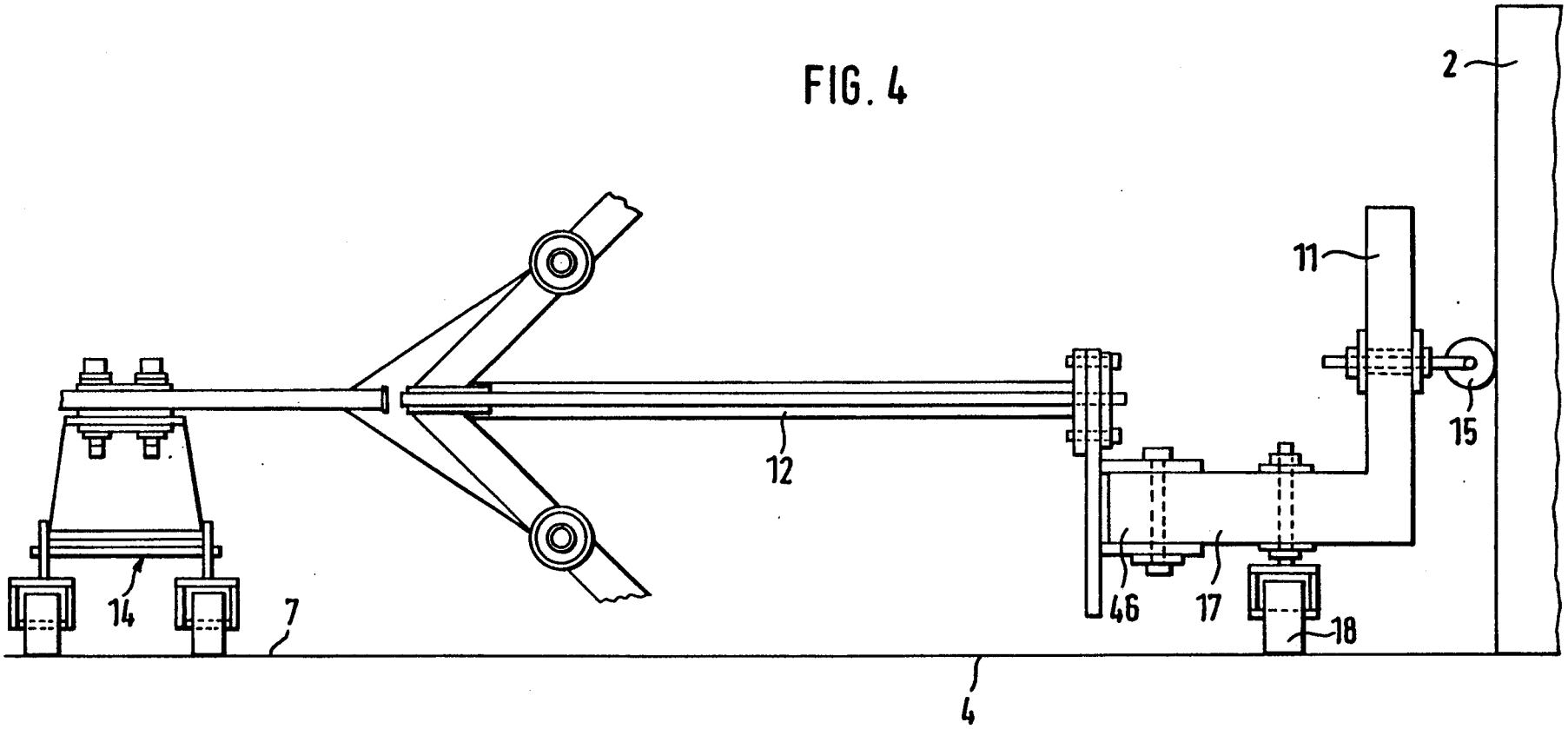
FIG. 4 is a part-sectioned view with associated swivel arm and load-carrying support in the area of the upper container wall.
Figure 6:
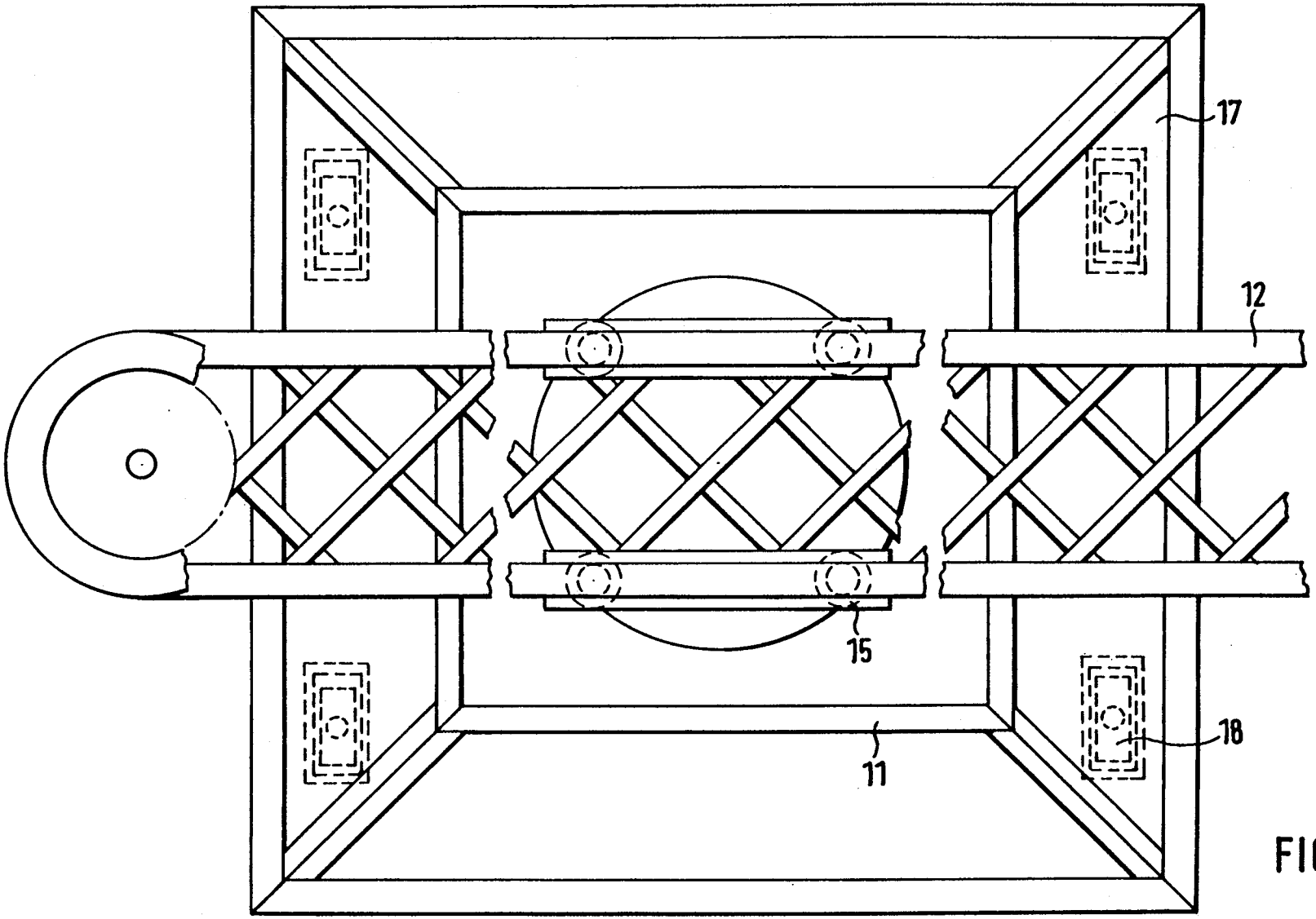
FIG. 6 is a top view of another embodiment of the device according to FIG. 3.

FIG. 3 shows several details of the first embodiment of a pivot mounting which is only diagrammatically indicated in FIG. 1. As can be seen, an air shaft 2 in the first embodiment is the central mounting for the scaffolding structure of the present invention, which is swingable around the full 360° angle of the container circumference. The axis of rotation or symmetry is therefore the vertical center line 8 of the air shaft as indicated in FIG. 3 as a dash-dot line. The pivot mounting 1 is at first characterized in that a swing or flange bushing 11 is provided with sleeve bearings 13 transversely penetrating its vertical wall sections. Track wheels 15 are disposed at the radially inward directed free ends of the sleeve bearings 13 and the wheels 15 run on the outer peripheral area of the cylindrical air shaft 2 supported thereby, whenever the pivot mounting and therewith the scaffolding structure are swung around. A plurality of such track wheels 15, adjustable in a horizontal direction and lockable by means of nuts 16, are provided around the peripheral area of the flange bushing 11. The lower part of the pivot mounting 1 is based upon a frame which may be hexagonal as shown in FIG. 2, or square as shown in FIG. 6. It is also possible to select any other frame shape of the pivot mounting 1.

Frame 17 accommodates, in vertical bores formed therein, axle bearings of height-adjustable rollers or wheels 18 which run on the surface of the container roof 4 supporting the pivot mounting 1. Struts 19 may be provided between the flange bushing 11 and the frame 17 for the purpose of increasing the stability of the total structure. The track wheels 15 are used as adjusting rollers with respect to the centering of the scaffold structure due to their horizontal adjustability, whereas the wheels 18 permit a simple axis-parallel alignment of the total structure due to their horizontal adjustability. At least one, preferably a plurality of equally spaced height-adjustable articulation pieces 46 are additionally provided on the frame 17 of the pivot mounting 1 which are shaped as rectangular buffer plates in the embodiment shown in FIG. 4 and are provided with slots which hold in turn the swivel arms 12 by means of bolts.

As seen in FIG. 1, a load-carrying support 14 is attached to the radially outer ends of each of the swivel arms 12 each in a manner as will be illustrated later, said load-carrying support 14 running around the container roof 4 along the upper container edge 7 whenever the pivot mounting 1 is swung around.

Figure 5:
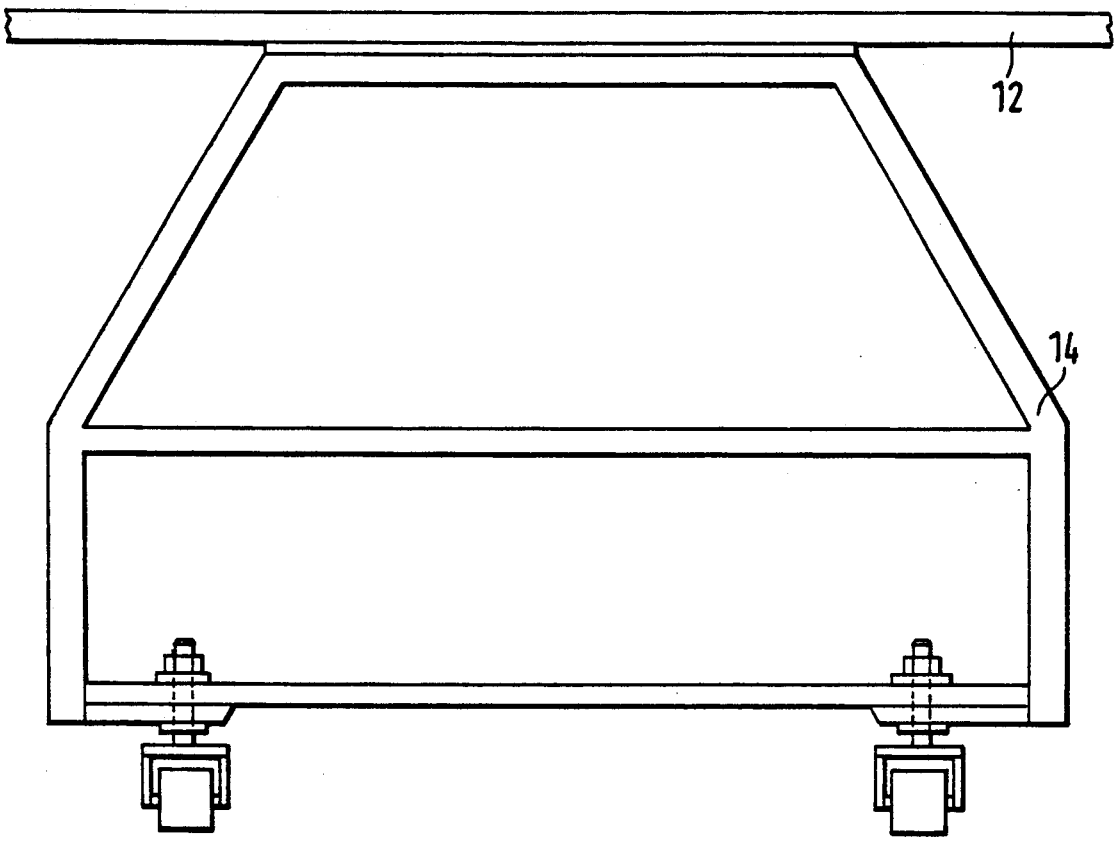
FIG. 5 is a side view of a possible form of load-carrying support.

FIG. 5 shows an enlarged cross-sectional view of a load-carrying support 14. It consists substantially of a simple frame structure with lower height-adjustable track wheels. It is, however, also possible without difficulties to construct such a carriage-like load-carrying support out of prefabricated tubular parts using tube-connecting sleeves, such as pipe straps and commercial lattice-work structures.

The ladder rungs of the scaffolding structure are hung up on the radially outer free ends of the extensions of the swivel arms 12 extending beyond the container edge, as will be shown later more in details, the working platforms to be inserted into the ladder rungs and locked in a manner as such known as in the case of other scaffolding structures. The embodiment of a load-carrying support as shown in FIG. 5 is restricted in its cross section to a trapezoid carriage structure having 4 or 8 wheels which can run freely around the total upper face of the large-capacity container and which are able to carry fully the total weight of scaffolding structure.

The scaffolding structure according to the first embodiment as shown in FIGS. 1 through 6 therefore constitutes a circulating structure, i.e., which runs around the full peripheral area of the container, running on the container roof 4, on which ladder rungs are hung up being able to carry any number of working platforms, by which in turn every spot of the outer skin of the large-capacity container is accessible for carrying out there maintenance work such as renovations, new painting, surveillance work and the like.

It is of no importance of how many parts the flange bushing 11 of the pivot mounting is eventually composed, so that the total structure can be composed of only a few prefabricated and standardized component parts. The rotary movement can be realized by means of simple chain or gear transmissions. The ladder structures which hang up on the radially outer ends of the swivel arms 12 are indicated with the reference mark 20 in FIG. 1. Finally, it may be pointed out here, that the swivel arm 12, as can be seen in particular from the embodiment according to FIG. 6, may consist also of a lattice-work structure the cross-section of which may have, e.g., a triangular shape. The device for hanging up the ladder structures or the working platforms is diagrammatically indicated on the left side of FIG. 6.

In the case of large-capacity containers or tank plants with a solid roof structure, however without an air dome, the embodiment of FIGS. 1 through 6 is replaced by a second embodiment as shown in FIGS. 7 through 10. The dome superstructure is replaced there by an axle support 21 set centrally upon the container roof, which is composed of an upper part 22 and a lower part 23. The lower 23 is connected with the upper part 22 by means of a plurality of shaft-like rods 24 along which a height-adjustable displacement between the upper and lower parts is possible.

Figure 7:
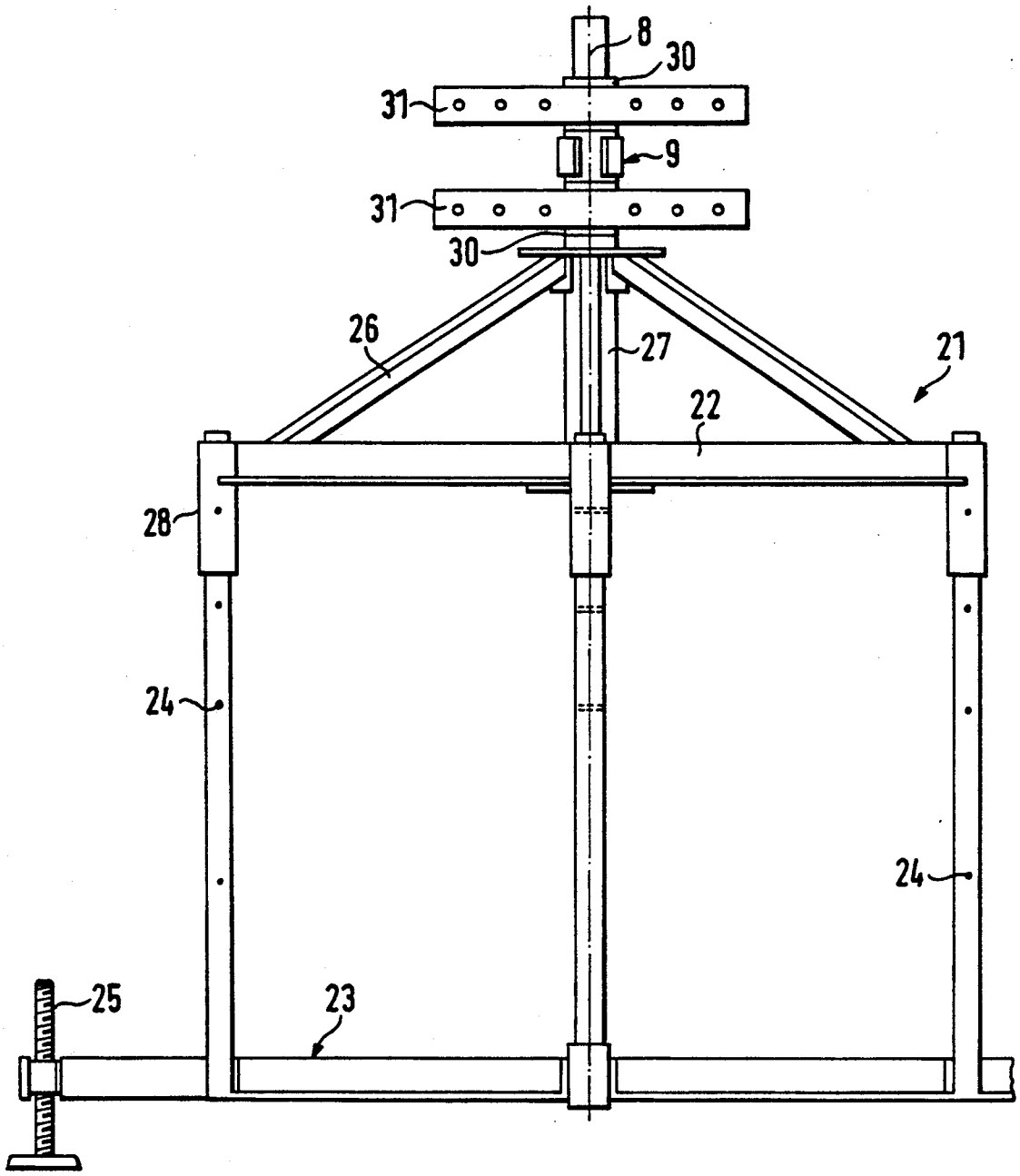
FIG. 7 is a side view of a pivot mounting of a large-capacity container without discharge dome.
Figure 8:
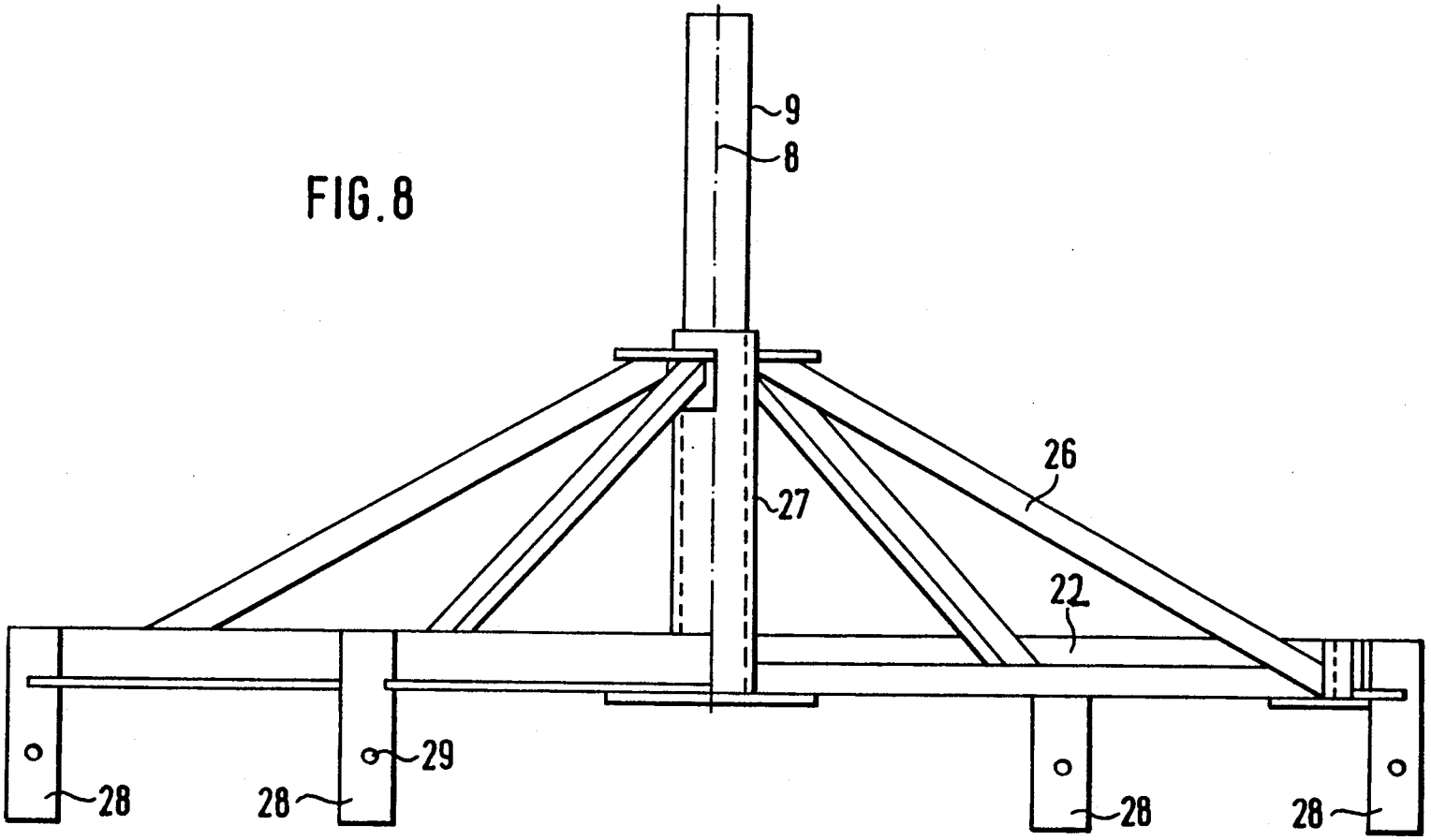
FIG. 8 is a side view of the pivot mounting.
Figure 9:
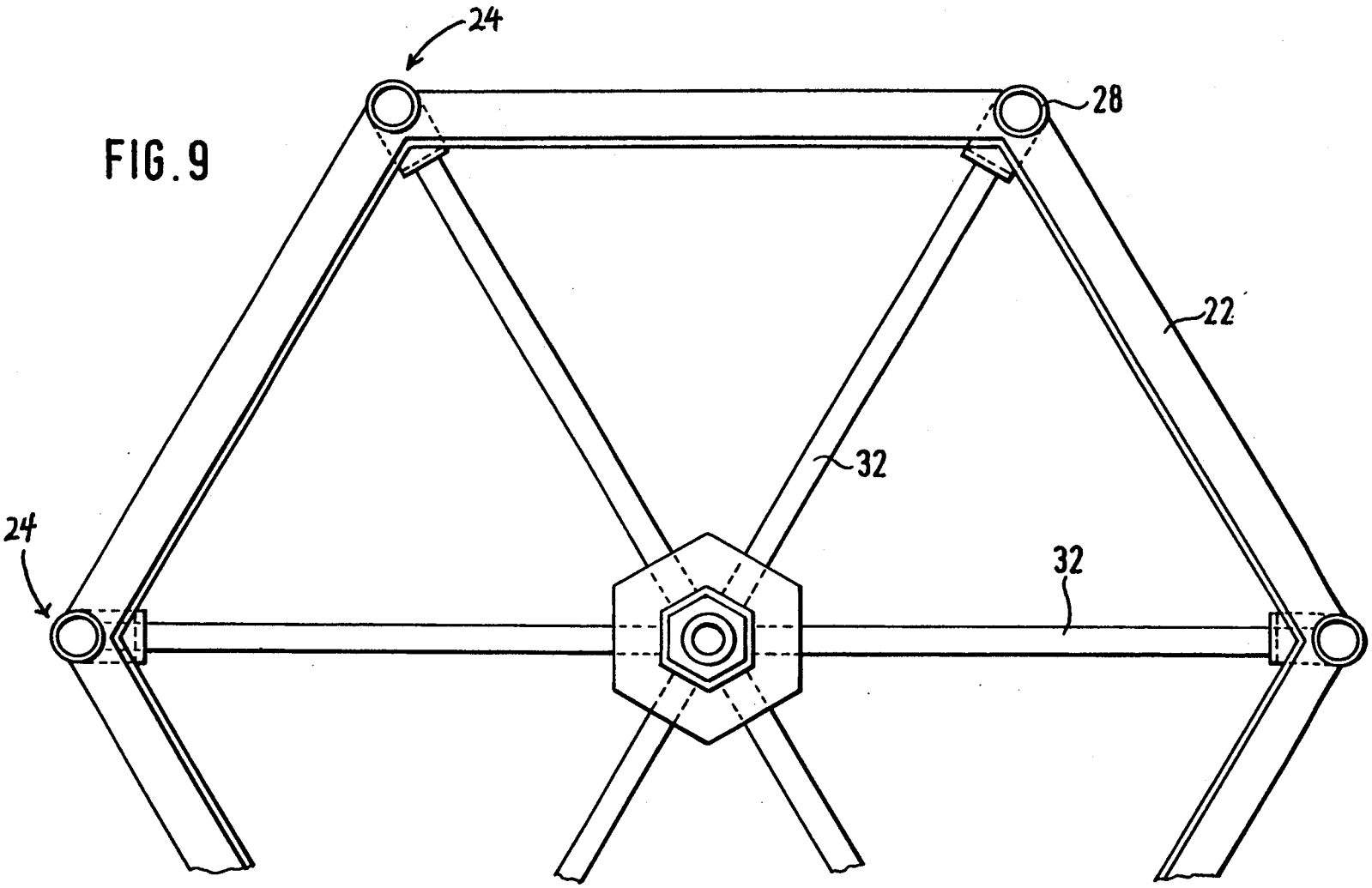
FIG. 9 is a top view of the pivot mounting according to FIGS. 7 and 8.
Figure 10:
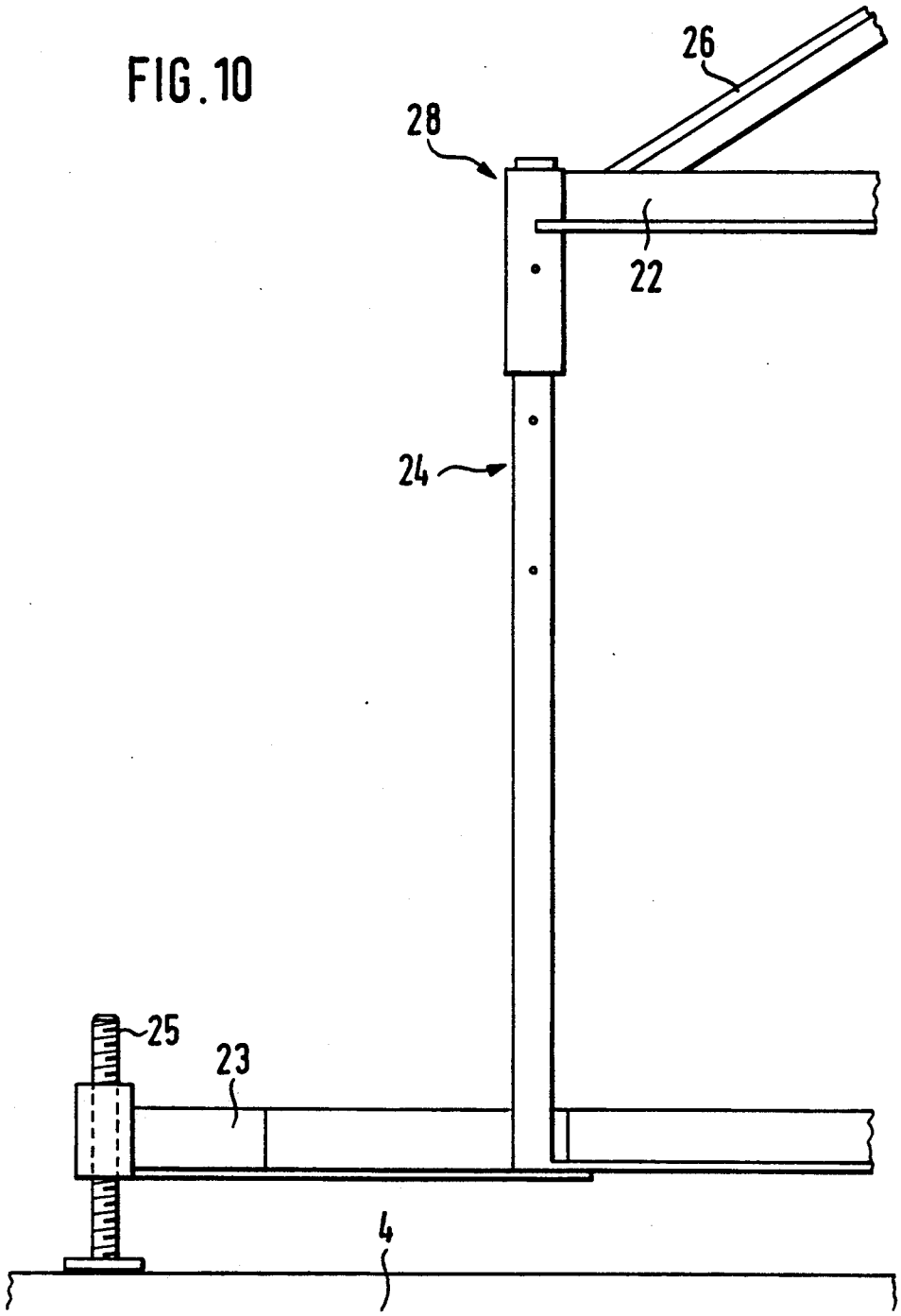
FIG. 10 is a partial view of the pivot mounting of FIG. 7, concerning its lower part.

In the second embodiment, as shown in particular in FIGS. 7-9, a total number of six such rods 24 equally spaced with respect to the vertical center axis 8 are provided, and the lower part 23 may consist of angular plates welded together in the area of the corners predetermined by the position of the rods 24, and the horizontal alignment of such polygon of angular plates may be adjusted by means of height-adjustable screw bolts such as that shown at 25 at the respective corners. The rods 24 are rigidly connected with the lower part 23 by inserting them into proper bushing holes along the mentioned angular plates, and locking, such as by fixing due to screws. The upper part 22 corresponds in its embodiment substantially to that of the lower part 23, so that it may also be made of angular plates, additional struts 26 holding a centered axle bearing 27 which is fixed twice, i.e., at its upper end and at its lower end. A center shaft 9 is inserted into the centered axle bearing 27 and is freely rotatable, such center shaft 9 protruding above the upper part 22 as illustrated in FIGS. 7 and 8.

The corner areas of the upper part 22 are provided with through-going vertical bushings and bores corresponding thereto which determine sliding bearings for the rods 24. The upper part 22 may be displaced in height over the total length of the rods 24 on the middle section of the supporting lower part 23, an infinitely variable fixation being possible to put movable rollers or wheels at the place of the height-adjustable feet 25, which are provided in the second embodiment at all six corners, or advantageously also at only three corners of the substructure, in order to be able to adjust the axle support 21 not only in a horizontal direction, but also to place it into any angular position with respect to a vertical sectional plane.

One or a plurality of bushings can be set upon the upper free end of the center shaft 9 the centerline of which coincides with the vertical centerline 8 of the container, such bushings being connected with attachment pieces, e.g., by welding, to which, in turn, the swivel arms 12 for accommodating the load-carrying supports 14, as described in FIGS. 1 through 6, shall be fastened. In FIG. 8, the bores 29 for the accommodation of fixing screws within the bearing bushings 28 of the upper part 22 are clearly visible; and in FIG. 8 as opposed to FIG. 7, no bushings 30 with the associated connection pieces are put on yet.

As shown in FIG. 9, both the lower part and the upper part are additionally secured by means of radial struts 32 besides the angular plates connecting the bearing bushings 28 with one another, or at least can thus be secured, the upper part 22 requiring particularly such radial struts 32 in order to fix firmly the center axle bearing 27 as shown, and to secure it against possible torques.

Various tank curvatures can be compensated due to the adjustment of the inclination angle toward the center as shown in the embodiment of FIGS. 1 through 6. Different axle lengths with correspondingly different tank diameters can be taken care of in a most simple way by using suitable extensions of the swivel arms 12 during mounting. In this context may be pointed out that it is possible to form the swivel arms 12 telescope-like, so that their lengths can be adjusted as required. An adjustable-length connection piece which is here not closer represented, serves as an end piece for compensating between the center and the load-carrying support, e.g., a steel plate having the respective bores, and a counterplate tiltable with respect the same permitting thus an infinitely variable adjustment of the angle of inclination of the swivel arm practically as required.

Figure 11:
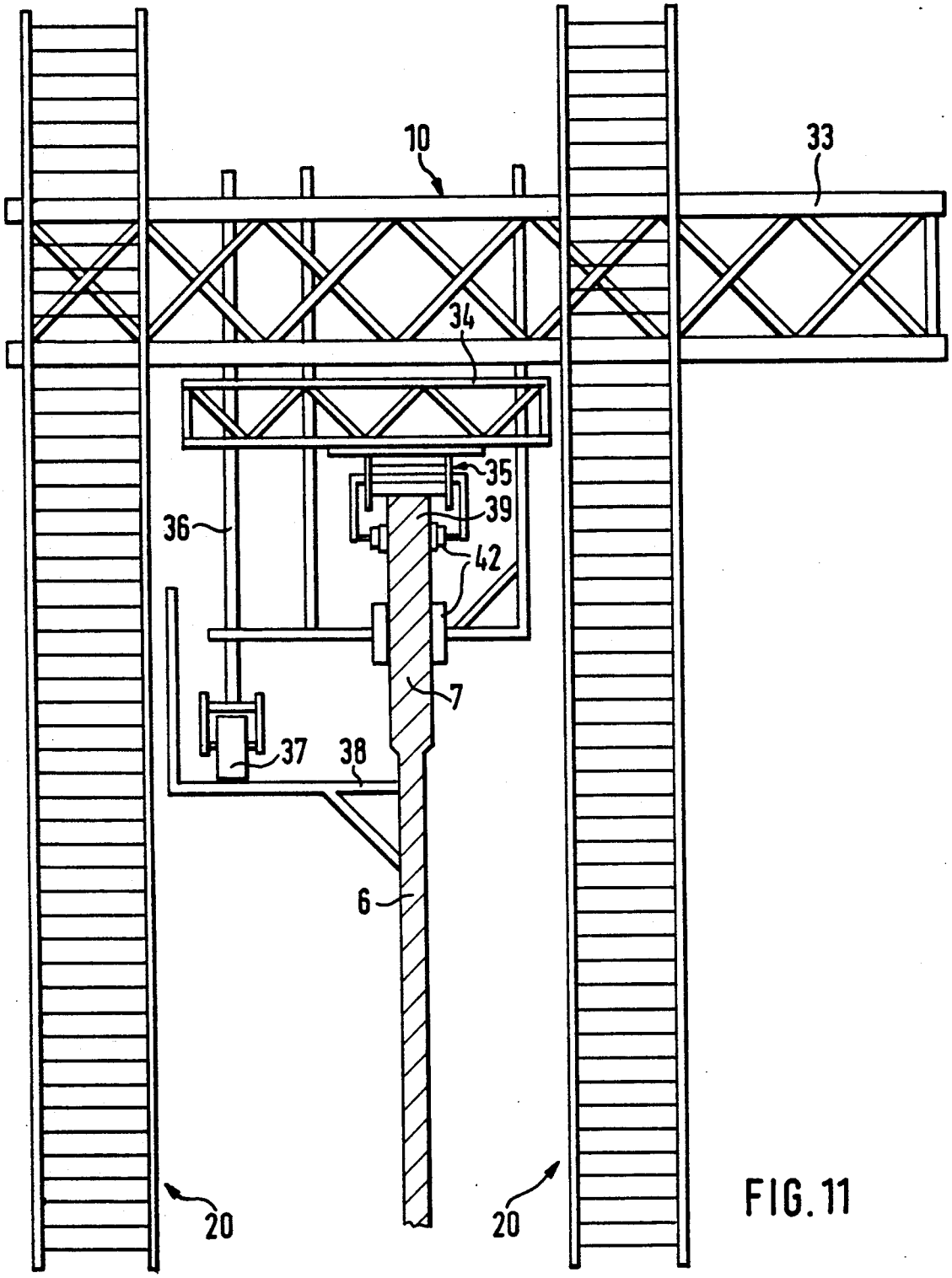
FIG. 11 is a side view of a scaffolding structure, dispensing with a central pivot mounting.
Figure 12:
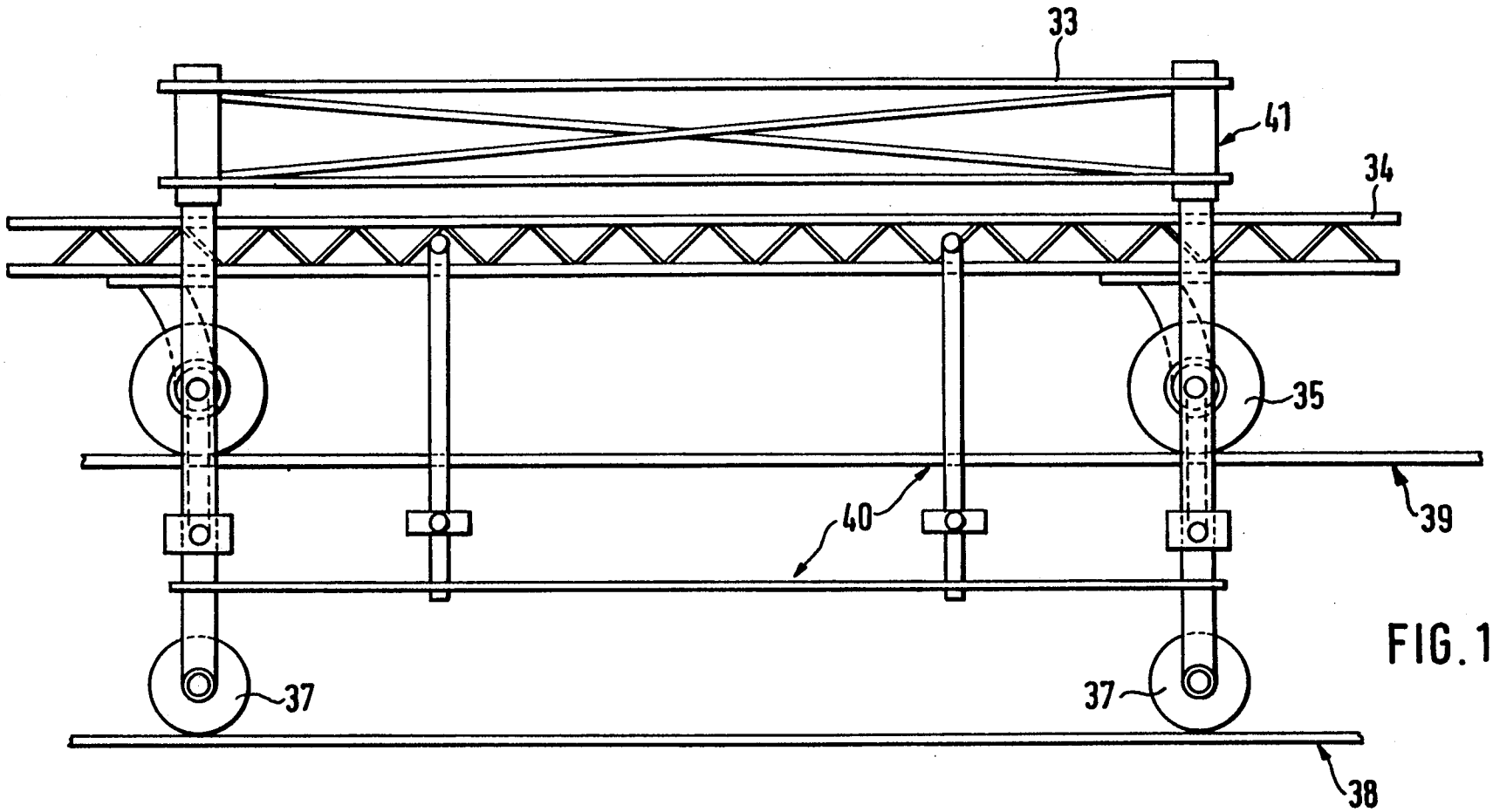
FIG. 12 is a side view of a part of the scaffolding structure according to FIG. 11.
Figure 13:
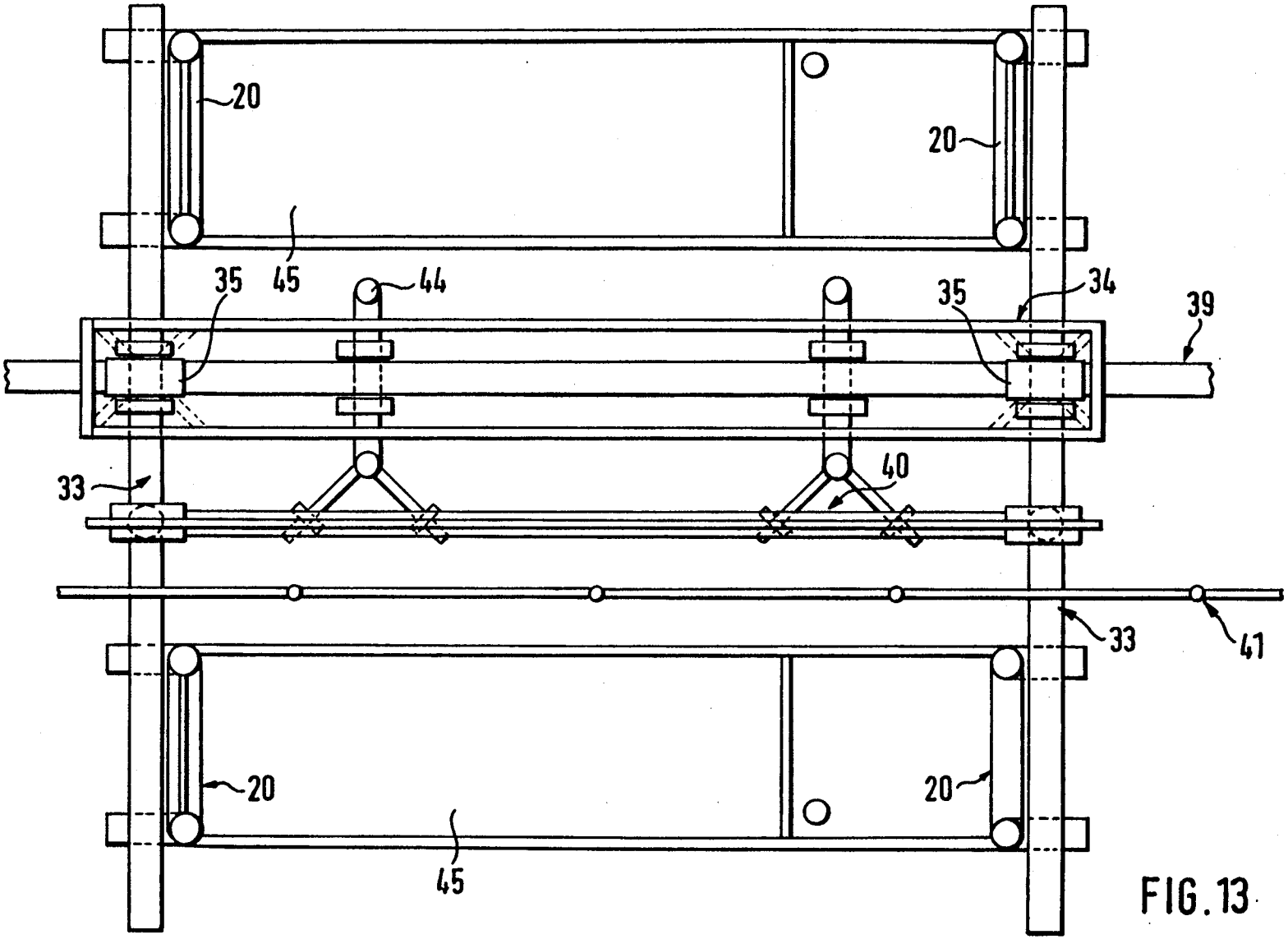
FIG. 13 is a further detailed view of the embodiment according to FIGS. 11 and 12.

Still further devices for the maintenance of large-capacity containers of a third embodiment are shown in FIGS. 11 through 13. This third embodiment is used for tanks with floating roofs. The load-carrying support 10 in such cases is not pivoted to a centrally fulcrumed swivel arm, but consists of an upper lattice girder 33 and a lower frame 34 which is supported on the upper tank edge 7 by means of roller devices 35, and additionally on the usually present tank catwalk 38 by means of links 36 and track wheels 37. The upper lattice girder 33 and the lower frame 34 which, together, determine the carriage shaped load-carrying support 10, accommodate ladder lattices 20, suitably connected with one another by bar structures in the radially outer area beyond the container wall 6 and in the radially inner area, such ladder lattices 20 being here insertable as usual, and which carry, in turn, the working platforms in the manner as described in the preceding examples.

The representation in FIG. 12 shows in particular that the track wheels 37 supported by the tank catwalk are height-adjustable vertically in adjusting boxes 21 with respect to the carriage-shaped load-carrying support 10 and thereby to further roller bearings 42, so that differing heights can be compensated. Struts 40 serve for further stiffening the device or the individual elements among one another. The roller or roll device 35 runs immediately upon the uppermost tank edge 39 and reposes directly on the lower frame 34 as visible in particular in FIG. 11, to which frame 34 also the upper roller couples of the roller bearing 42 are fastened, whereas the lower roller couples of the lower roller bearings 42 are accommodated both on the frame 43 by means of rod structures and on the lattice girder 33.

FIG. 13 finally is a horizontal sectional view of the device according to FIG. 11. It is clearly visible that the ladder lattices 20 are fastened, that is hung up in a suitable manner, in the radially outer and radially inner areas of the tank wall or the upper tank edge 39, said ladder lattices carrying in turn the working platforms 45. The bushings 44 serve for the relative displacement of the here guided roller device on the one hand, and of the track wheels 37 on the other hand. The reference mark 41 denotes the handrail of the tank catwalk 38. Working platforms 45 can be inserted into the ladder lattices vertically hanging downward at any required height and in any required number, both in the inner and in the outer areas, as known in the scaffolding trade. Since the carriage-like load-carrying support 10 reposes, on the one hand, on the uppermost tank edge 39 by means of the roller device, on the other hand, however, at a certain distance from same, by means of the track wheels 37 on the tank catwalk 38, and is furthermore supported on the reinforced wall area 7 at two differing heights as defined by means of the roller bearing 42, swinging out or another twisting of the said ladder lattices 20 is not to be expected even through same be mounted only at one side, e.g., in the radially outer area of the large-capacity container. The thus supported device is thus able to be rolled with the complete scaffolding structure around the full peripheral area of the large-capacity container.

Having, thus, described the invention, what is claimed is:

1. A device for the maintenance of a large-capacity container having a substantially round cross section and an upper edge, comprising:

a scaffolding structure for accommodating a plurality of working platforms along a wall, said scaffolding structure being fulcrumed swingably around a vertical centerline which forms an axis of symmetry of the large-capacity container as a rotational axis, the scaffolding structure being movably placeable on an area of the upper container edge, the scaffolding structure comprising:

(a) a pivot which is centrally mountable on a roof of the container;

(b) a plurality of pivoting swivel arms for extending radially outwardly from the pivot mounting and having free ends for protruding beyond the container wall; and (c) ladder lattices fastenable to the free ends of the swivel arms.

2. The device of claim 1, wherein said pivot mounting is horizontally adjustable and vertically settable around an air dome on the container roof.

3. The device of claim 2, further comprising load-carrying supports in the area of the upper container edge of the storage container, the swivel arms being height-adjustably disposed on the supports.

4. The device of claim 1, further comprising a plurality of connecting struts interconnecting the swivel arms in a fixed angular relationship.

5. The device of claim 1, wherein said pivot mounting comprises:

(a) a flange bushing (b) a frame surrounding the flange bushing and affixed thereto, (c) horizontally adjustable track wheels accommodated by the flange bushing, and (d) vertically adjustable rollers accommodated by the frame.

6. The device of claim 5, further comprising a plurality of arm holders attached to said frame for holding the swivel arms.

7. The device of claim 1, further comprising an axle support centrally placed upon the container roof, the axle support comprising (a) an upper part (b) a lower part, (c) screw bolts threadably engagable with the lower part to permit horizontal adjustment of the axle support on the container roof, (d) an axle shaft disposed in the upper part and which is aligned centrally with respect to a vertical centerline of the container, (e) placeable bushings disposed on the axle shaft, and (f) connection pieces surrounding the placeable bushings and holding the swivel arms.

8. The device of claim 7, further comprising a plurality of rods for interconnecting said upper part and said lower part of the axle support, the upper part being height-adjustable with respect to the lower part by means of the rods.

9. The device of claim 1, wherein that said pivot mounting comprises a load-carrying support movable on the upper container edge and on a tank catwalk and supported by same, said load-carrying support comprising in turn a lattice girder and a lower frame.

10. The device of claim 9, wherein the lattice girder and the lower frame are force-lockingly and form-lockingly connected with one another by means of the bar structures and struts.

11. The device of claim 10, further comprising roller bearings in couples fastened to the load-carrying support in different heights being adjustable in horizontal or vertical direction while protruding over the upper container edge.

12. The device of claim 11, wherein said ladder lattices are placed on the lattice girder of the load-carrying support.

* * * * *

UNITED STATES PATENT OFFICE

CERTIFICATE OF CORRECTION

Patent No. 5,007,500 Dated April 16, 1991

Inventor(s) Harald Klähne

It is certified that error appears in the above-identified patent and that said Letters Patent is hereby corrected as shown below:

Title page: Item (75) inventor should read:

-- Harald Klähne --

Signed and Sealed this

Fifteenth Day of September, 1992

*Attest:*

DOUGLAS B. COMER

*Attesting Officer*

*Acting Commissioner of Patents and Trademarks*